US007540464B2

(12) United States Patent
Samari

(10) Patent No.: US 7,540,464 B2
(45) Date of Patent: Jun. 2, 2009

(54) BOOK HOLDER

(75) Inventor: Badiollah R. Samari, 3921 E. La Palma Ave., Unit P, Anaheim, CA (US) 92807

(73) Assignee: Badiollah R. Samari, Anaheim, CA (US)

( * ) Notice: Subject to any disclaimer, the term of this patent is extended or adjusted under 35 U.S.C. 154(b) by 112 days.

(21) Appl. No.: 11/509,125

(22) Filed: Aug. 23, 2006

(65) Prior Publication Data

US 2007/0045503 A1 Mar. 1, 2007

Related U.S. Application Data

(60) Provisional application No. 60/711,405, filed on Aug. 26, 2005.

(51) Int. Cl.
*A47B 23/00* (2006.01)

(52) U.S. Cl. ..... 248/445; 248/346.07; 248/451; 84/486

(58) Field of Classification Search ..... 248/445, 248/441.448, 451, 447.1, 346.07, 346.03, 248/346.06; 281/45, 43, 47, 49; 40/531; 84/521, 487, 519, 504, 494
See application file for complete search history.

(56) References Cited

U.S. PATENT DOCUMENTS 1,825,716 A * 10/1931 Courtenay ..... 248/448
2,104,072 A 1/1938 Carr
2,480,233 A * 8/1949 Lee ..... 108/4
3,061,969 A * 11/1962 Lee ..... 248/448
3,408,032 A * 10/1968 Francis ..... 248/450
3,514,066 A 5/1970 Singleton et al.
4,021,013 A 5/1977 Wiersma
4,936,034 A 6/1990 Chen et al.
5,199,680 A 4/1993 Rivera
5,375,806 A 12/1994 Debus et al.
5,433,415 A * 7/1995 Samson et al. ..... 248/448
5,595,074 A * 1/1997 Munro ..... 70/58
5,615,856 A 4/1997 Simington
5,671,900 A 9/1997 Cutler
5,971,344 A 10/1999 Ainsworth
5,979,857 A 11/1999 Holm
5,979,940 A 11/1999 Araghi
6,585,212 B2 * 7/2003 Carnevali ..... 248/346.07
6,590,148 B1 * 7/2003 Medina ..... 84/486
6,796,536 B1 * 9/2004 Sevier, IV ..... 248/121
2001/0011819 A1 8/2001 Tao
2004/0007651 A1 * 1/2004 Williams et al. ..... 248/346.06
2005/0189465 A1 9/2005 Matsuoka

* cited by examiner

*Primary Examiner*—Anita M King

(57) ABSTRACT

The present invention is an improved book holder. In particular, the present invention is directed to a book holder with easy loading and unloading of reading material, a page turning mechanism, book centering mechanism and/or a foldable book holder stand. The book holder preferably has a book support plate with a central gear with a plurality of teeth. A book is held by the invention by first and second book clamps having page-turning fingers pivotally connected to clamps. The fingers have flexible silicone rubber pads. The clamps are further adjustably attached to toothed arms engaged to the teeth of the central gear. Each clamp is held in place on the book on a pin by a bushing.

12 Claims, 10 Drawing Sheets

BOOK HOLDER

This patent application is based on provisional U.S. Pat. Appl. Ser. No. 60/711,405 filed on Aug. 26, 2005 which is fully incorporated herein by reference.

TECHNICAL FIELD

The present invention is an improved book holder. In particular, the present invention is directed to a book holder with easy loading and unloading of reading material, a page turning mechanism, book centering mechanism and/or a foldable book holder stand.

BACKGROUND ART

Generally, book holders hold books, magazines and other reading material so as to allow a person to read while sitting or laying down without having to hold the reading material up and to keep the material open to a particular spot. Book holders can allow a person to read in many different positions without incurring, inter alia, fatigue from holding the material. A number of book holders are known including U.S. Pat. No. 5,615,856 to Simington, U.S. Pat. No. 5,671,900 to Cutler, and U.S. Pat. No. 5,199,680 to Rivera.

However, the prior art book holders can be cumbersome to adjust or do not allow for ease and/or simplicity in loading books and/or turning pages of reading material. For example, the Rivera reference is large and cumbersome and does not adequately address book loading or page turning. The present invention provides an improved book holder that is easily adjustable, can load and unload reading material with minimal effort, and provides for ease in page turning.

SUMMARY OF THE INVENTION

The present invention is an improved book holder. In particular, the present invention is directed to a book holder with easy loading and unloading of reading material, a page turning mechanism, book centering mechanism and/or a foldable book holder stand. The book holder preferably has a book support plate with a central gear with a plurality of teeth. A book is held by the invention by first and second book clamps having page-turning fingers pivotally connected to clamps. The fingers have flexible silicone rubber pads. The clamps are further adjustably attached to toothed arms engaged to the teeth of the central gear. Each clamp is held in place on the book on a pin by a bushing.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

[1] The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved book holder.

Figure 1:
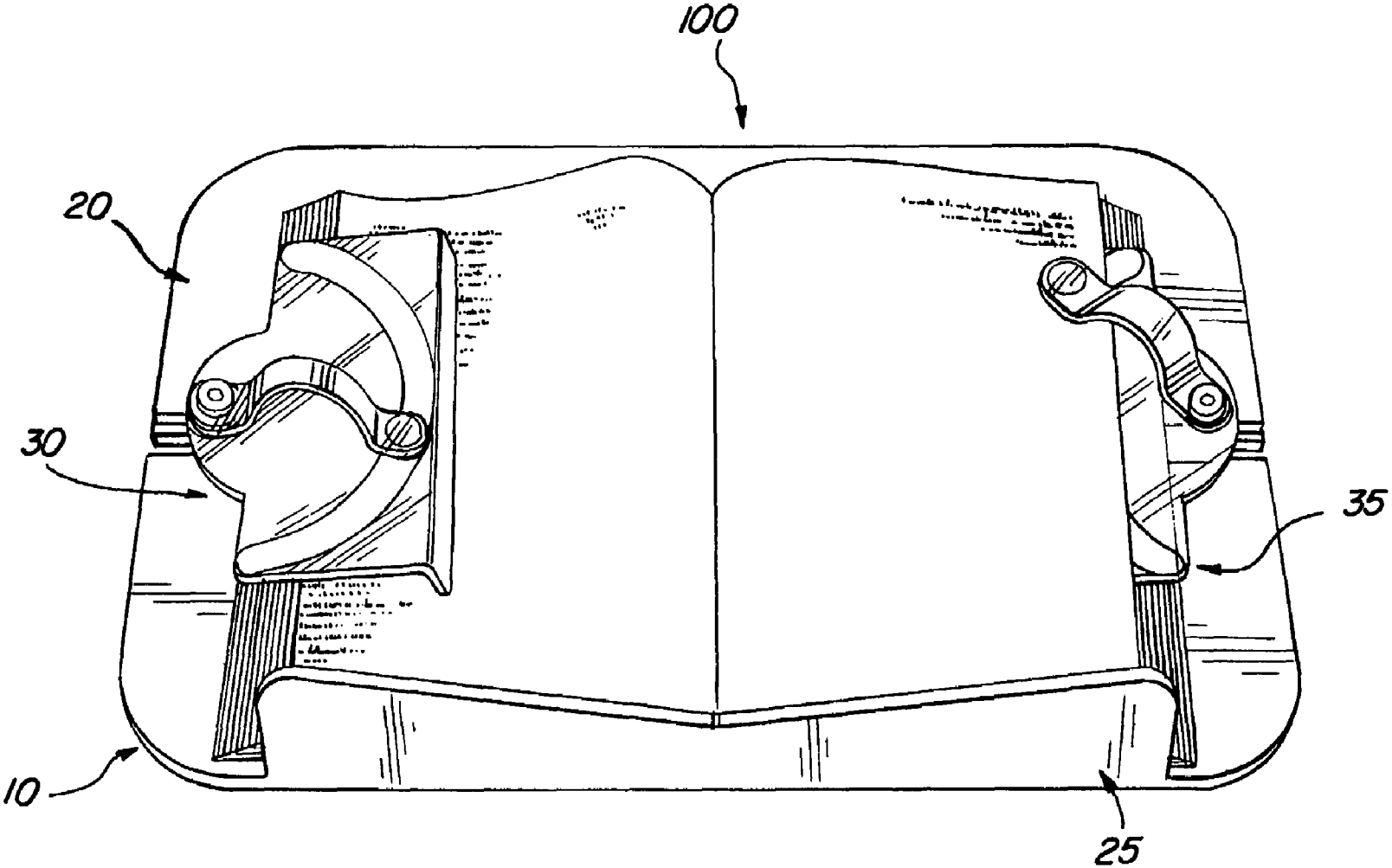
FIG. 1 is a perspective view of a preferred embodiment of the invention holding a book and without a base.

[2] Referring now to FIG. 1, a preferred embodiment of the invention 10 is shown holding a book 100. The preferred embodiment comprises a book support plate 20. The plate 20 preferably has a shelf 25 to, inter alia, stabilize reading material in the holder 10. The book 100 shown is held on the plate 20 by a first book clamp 30 and a second book clamp 35.

Figure 2:
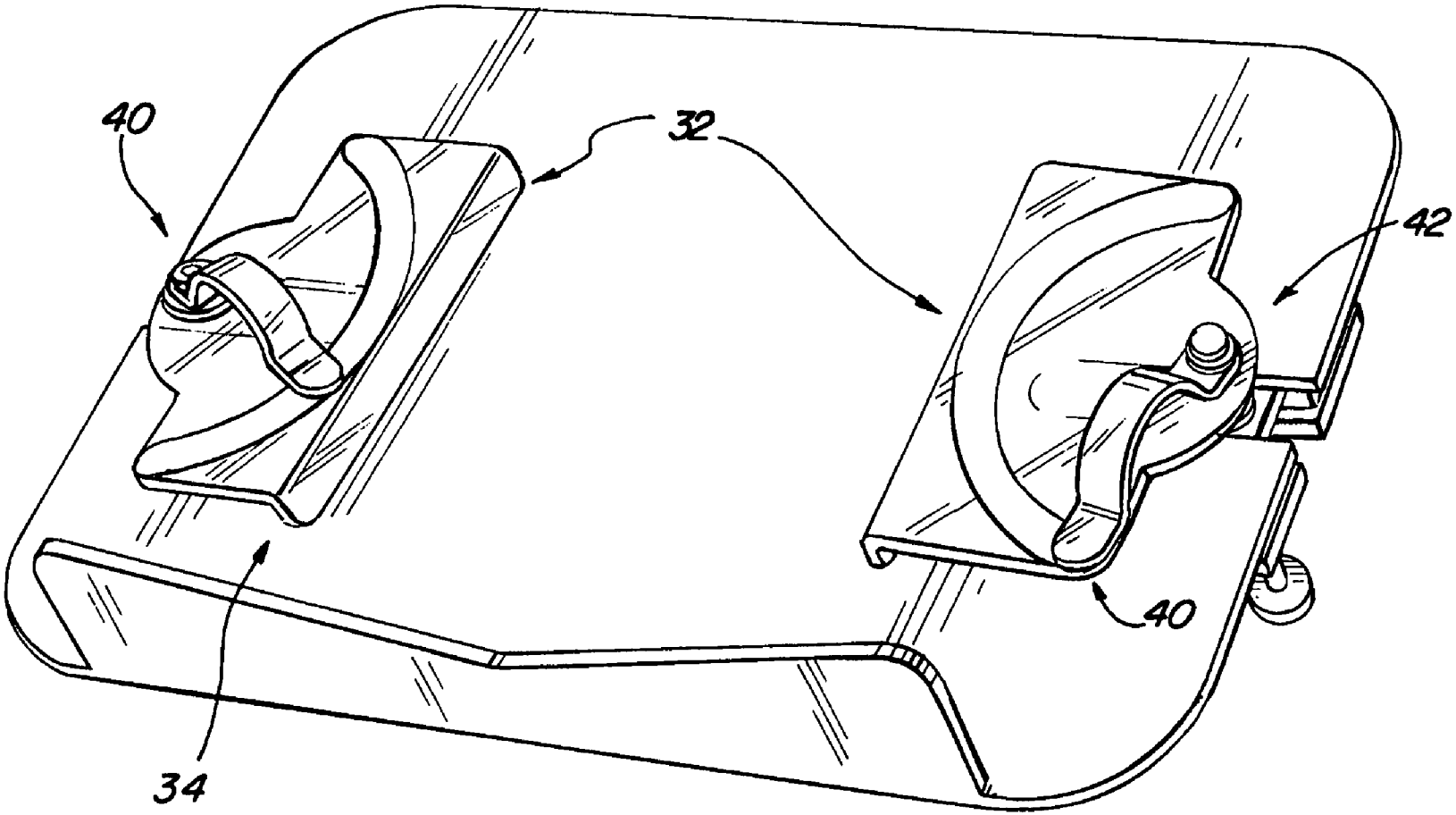
FIG. 2 is a perspective view of a preferred embodiment of the invention without a base.
Figure 5:
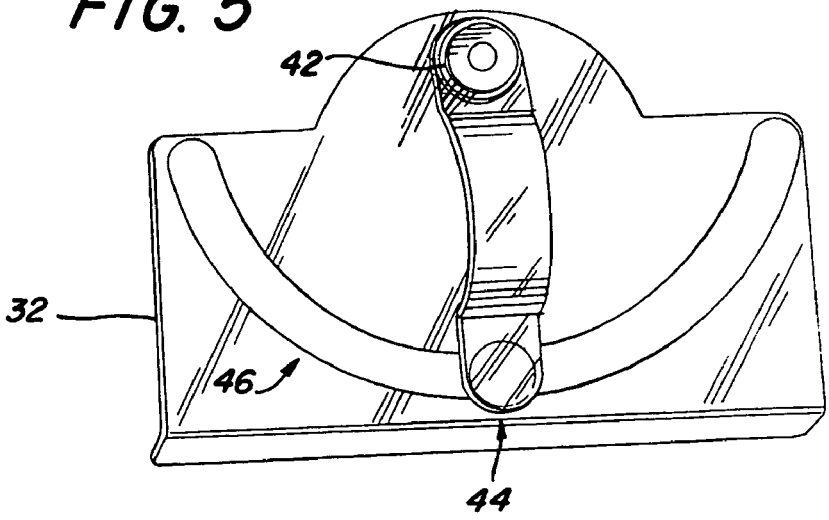
FIG. 5 is a top view of a preferred embodiment of a book clamp.
Figure 6:
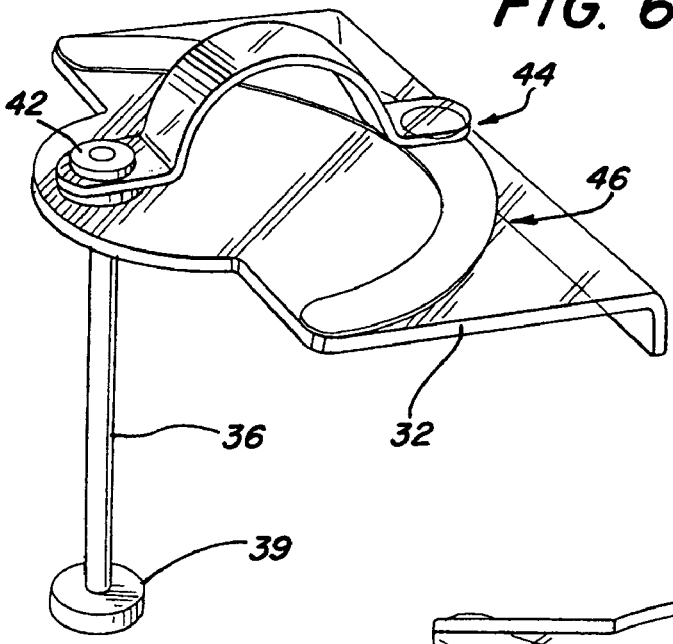
FIG. 6 is a side view of a preferred embodiment of a book clamp.
Figure 7:
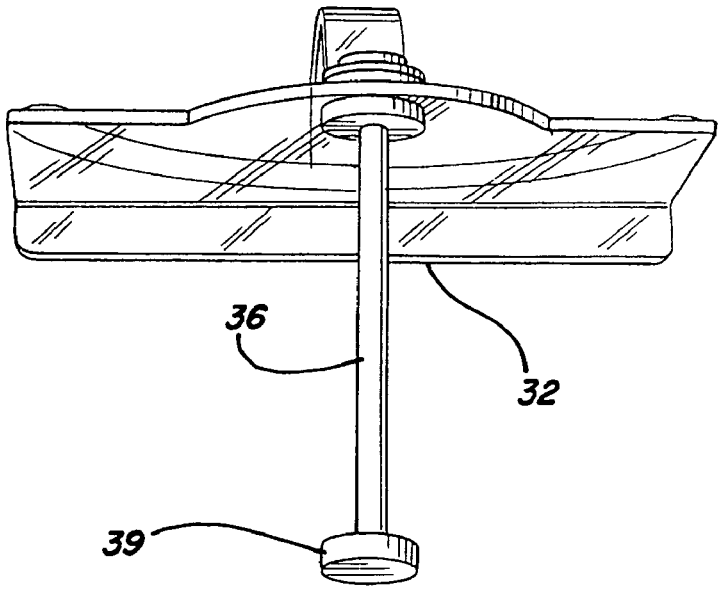
FIG. 7 is a side view of a preferred embodiment of a book clamp.

[3] The first and second book clamps 30, 35, as shown in FIG. 2, preferably each comprise a book clamp plate 32. The book clamp plates 32 can be flat but preferably have a roughly orthogonal or bent edge 34. This reduces surface-to-surface contact with the reading material but still allows for the invention 10 to maintain a firm hold on reading material 100. The preferred embodiments of the book clamps further comprise page-turning fingers 40. The fingers 40 preferably pivot about a single axis point 42. The fingers 40 are also preferably curved. The curved fingers 40 reduce frictional contact with pages of reading material 100 and provide a convenient raised handle for manipulating the fingers 40. As shown in FIGS. 5 and 6, the tip of the fingers 40 preferably have pads 44. These pads 44 are preferably made of a flexible, tacky material such as silicone rubber so as to better grip pages of reading material 100 for turning. Alternately, any tacky material useful for gripping the pages of the reading material 100 could be used. The clamp plates 32 can further comprise at least a portion of an increased frictional surface 46. An arc 46 as shown in the preferred embodiments is the preferred shape of the increased frictional surface and is preferably silicone rubber or a similar material to the pads 44. The clamp plates 32 and fingers 40 are preferably made of clear polycarbonate plastic. Alternately, any other material could be used such as clear acrylic or other plastics, metal, wood, etc.

[4] Thus, preferably, up to one hundred pages of a book 100 can be held between the finger 40 and the book clamp plate 32. The fingers 40 can be rotated about the axis point 42 so as to lift a page for turning from the stack of pages on the clamp 30. The remaining pages, preferably in contact with the arc 46 of increased friction, remain generally in place while the page is turned by the rotated finger 40. As shown in FIG. 1, the remaining pages not being read and not between the finger 40 and clamp plate 32 are held beneath the clamp plates 32 and atop the book support plate 20. Preferably, the fingers 40 can be rotated 360 degrees.

Figure 3:
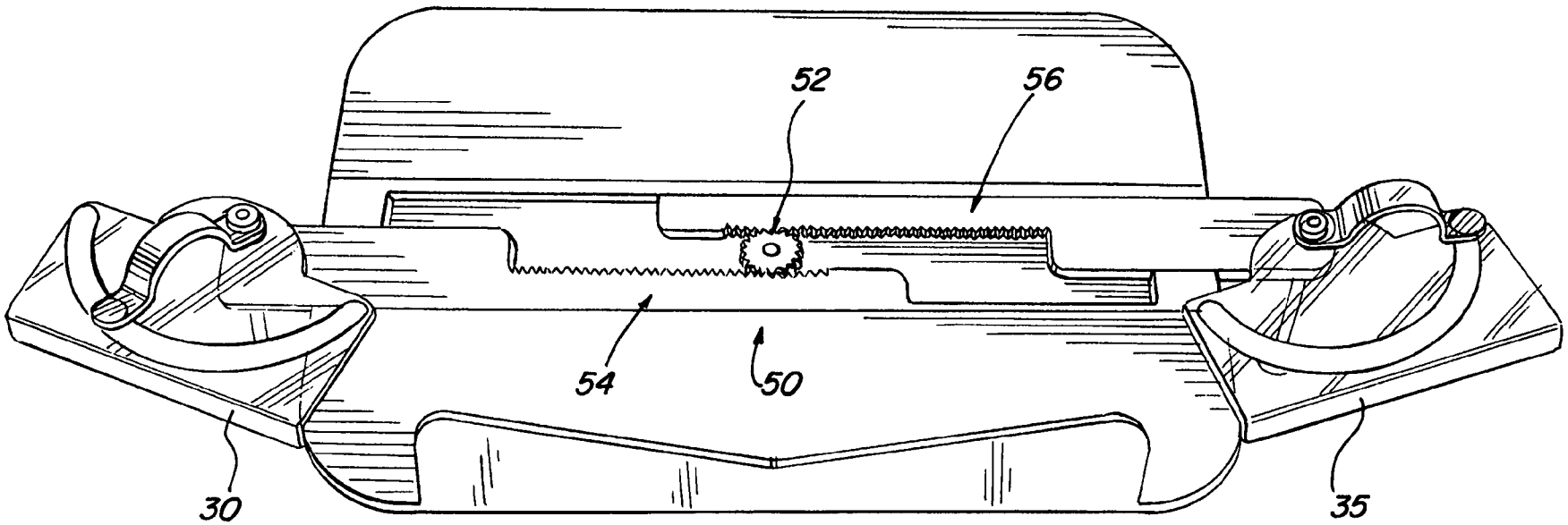
FIG. 3 is a perspective view of a preferred embodiment of the invention with the book centering mechanism exposed.

[5] Turning now to FIG. 3, the preferred embodiment of the book centering mechanism 50 is shown exposed. In the embodiment shown, the book support plate 20 has a central gear 52 with a plurality of teeth. The first book clamp 30 has a first toothed arm 54 and the second book clamp 35 has a second toothed arm 56. The teeth of both the first and second arms 54, 56 mesh with and engage the central gear 52 so that the arms 54,56 and therefore the clamps 30, 35 can move together in unison about a central point on the book support plate 20. Alternatively, a disc with a tacky perimeter can replace the toothed gear 52 and the arms 54, 56 can have flat surfaces with a similar tacky material to approximate the toothed gear arrangement described above. The clamps 30, 35 can be moved in and out depending on the size of the book 100 to be held. Additionally, the book support plate 20 is preferably slotted with first and second slots 22, 24. See FIG. 4. Thus, the clamps 30, 35 can be moved together closer than the book support plate's perimeter.

Figure 9:
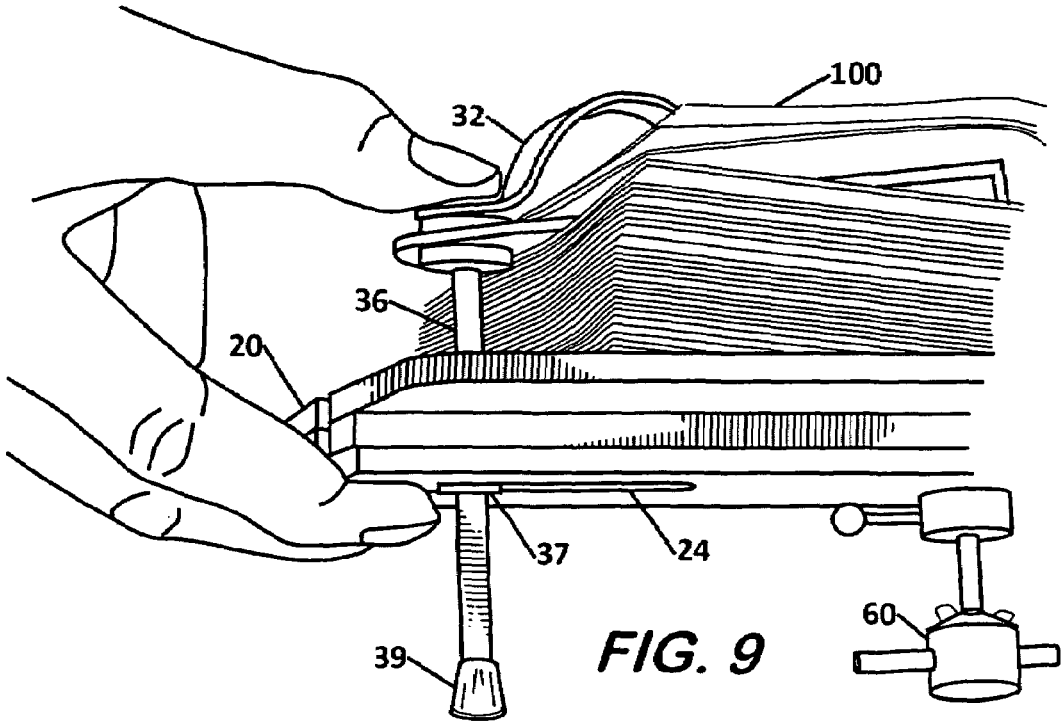
FIG. 9 is a side view of a preferred embodiment of a book clamp being adjusted to hold a book.
Figure 9A:
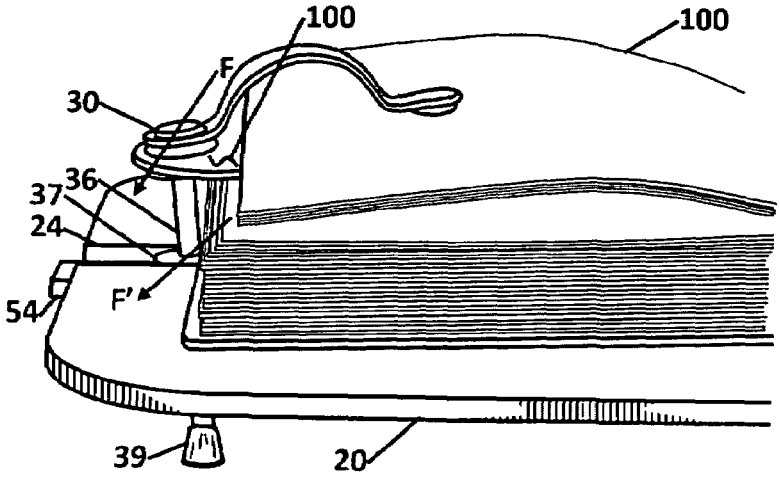
FIG. 9*a* is a diagram of a side view of a preferred embodiment of the book clamp in use with arrows depicting forces.
Figure 9B:
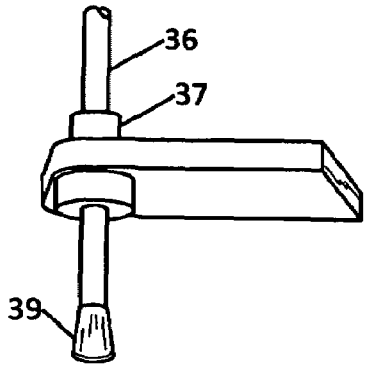
FIG. 9*b* is a cross-sectional close up of the preferred bushing arrangement.

[6] Turning now to FIGS. 9, 9*a* and 9*b*, side views of a book clamp 30 being adjusted is shown. The page turning finger 40 and clamp plate 32 are attached to a pin 36. The pin 36 slides into the slot 24 of the book support plate 20 through a bushing 37. (The pin 36 can be smooth or threaded.) The bushing 37 and pin 36 are then inserted through the arm 54. The bushing 37 holds the pin 36 in place once adjusted so the book clamp plate 32 can firmly hold the book 100 to the book support plate 20 but also be adjusted for insertion and removal of the book 100 and for books of varying thickness. This is accomplished as follows: Forces generally at work are shown as Forces F and F' in FIG. 9*a*. When the pin 36 is generally pushed down (F) through the bushing 37, the pin 36 exerts a force (F') or pressure on the bushing 37. This diagonal or roughly horizontal pressure holds the pin 36 firmly in place by force of friction. The further the pin 36 is pushed down, the more pressure on the bushing 37 and therefore, more friction between the pin 36 and the bushing 37. This allows for a tighter grip on the book 100 by the book clamp 30. When the pin 36 is pushed up from below, the pressure and frictional forces are relieved, and the pin 36 and clamp plate 32 easily slide up to allow for removal of the reading material 100. Preferably, books and reading material of between 5 to 18 inches in width (in open position) and up to 3.0 inches thick (in closed position) can be loaded into the invention 10. The pin 36 preferably has a stopper 39 at the end to prevent the pin 36 from sliding out of the bushing 37. FIG. 9*b* shows a close-up cross-sectional view of the pin 36 and bushing 36 in the arm 54. The bushing 37 is preferably rubber and has a first diameter of ¾ of an inch and a second diameter of ½ inch. Alternately, a two bushing arrangement could be used with one bushing above the arm 54 and one below the arm 56.

[7] Thus, the preferred method of loading reading material 100 into the invention 10 is as follows. First, slide the arms 54, 56 apart and pivot the clamps 30, 35 away from the book support plate 20. Next, place open reading material 100 on the book support plate 20 and on the shelf 25. Then, contract the arms 54, 56 to the width of the open book 100. Rotate the clamps 30 and 35 over the pages of the reading material 100. Next, push the clamps 30, 35 down the pins 36 so that the clamps 30, 35 contact the surface of the book 100 and hold it to the book support plate 20. To prepare the text 100 for reading, place a portion of the pages, or stack, between a finger 40 and clamp plate 32 and arc 46.

[8] To turn pages, a finger 40 on the page to be turned is rotated. The pad 44 effectively grabs the surface of the page and lifts (and separates) the page from the rest of the stack between the finger 40 and the book clamp plate 32. The remainder of the stack resists movement due to the contact with the arc 46. Pages turned can then be inserted between the opposing finger 40 and clamp plate 32. To remove the material 100, remove any pages from between the fingers 40 and clamp plates 32; push up on both pins 36 to raise the clamps 30, 35; and rotate the clamps 30, 35 clear of the material 100. Then removed the book 100 from the book support plate 20.

Figure 4:
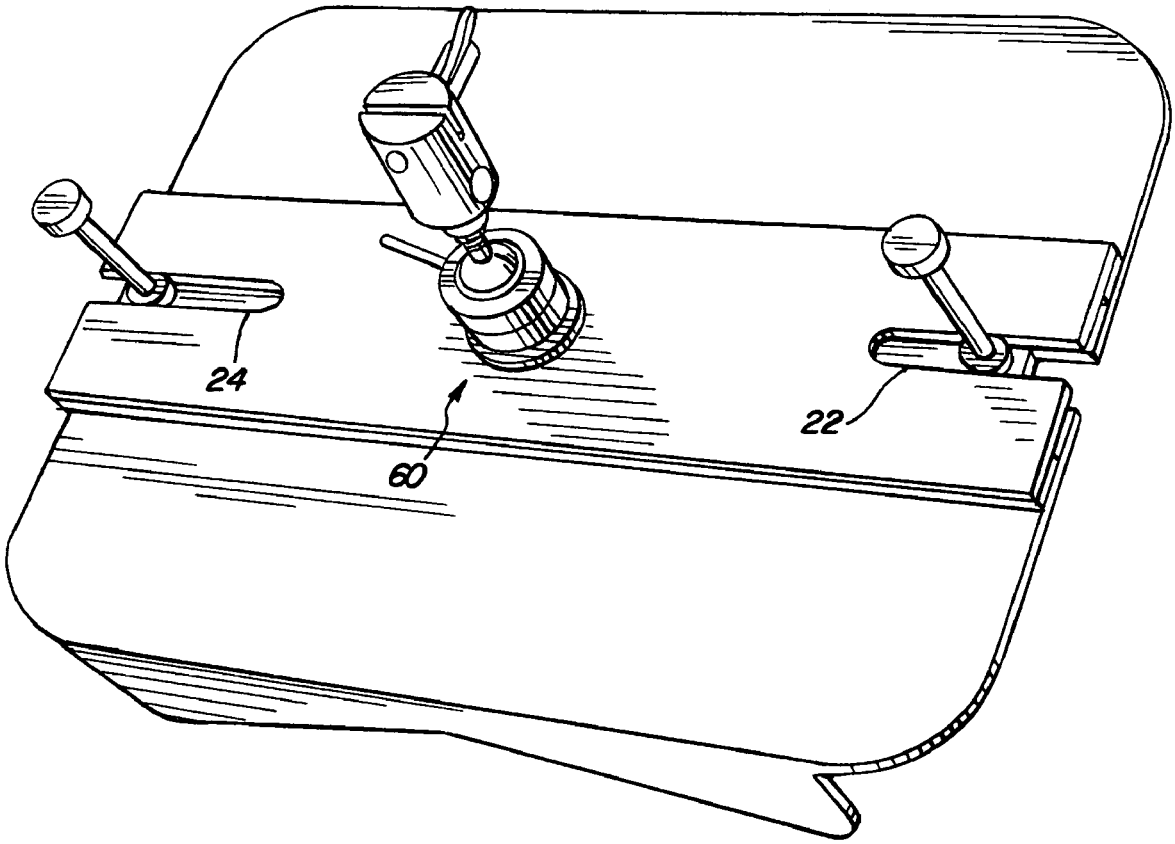
FIG. 4 is a perspective rear view of a preferred embodiment of the invention.
Figure 10:
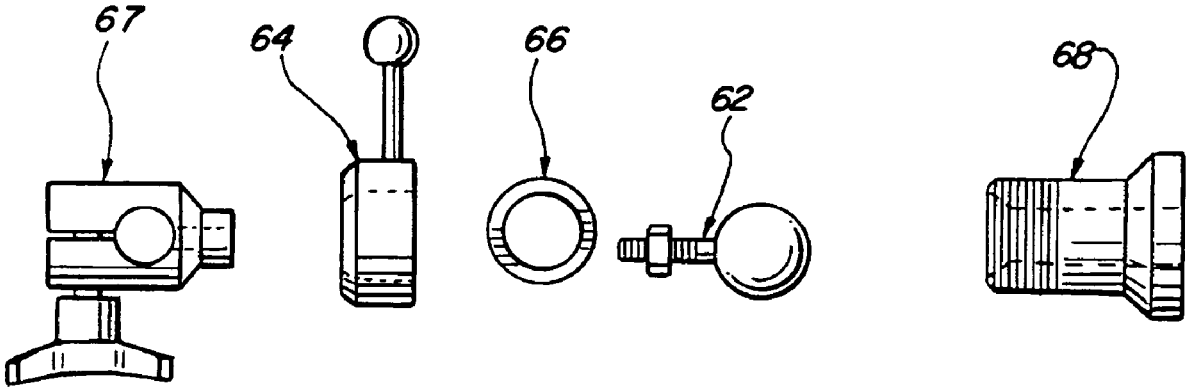
FIG. 10 is an exploded view of the ball socket joint used on the preferred embodiment of the invention.

[9] Turning now to FIG. 4, the preferred embodiment of the back of the book support plate 20 is shown. Centrally mounted to the back of the book support plate 20 shown is a ball socket joint 60. This allows the book support plate 20 to be pivotally attached to a base 70 so that the book support plate can be maneuvered to a variety of positions for use. FIG. 10 shows a preferred embodiment of the ball socket joint 60. The ball 62 sits on a ring 66 and in socket 64. Preferably, the ring 66 is only slightly smaller in diameter than the ball 62. This helps maximize maneuverability. The ring 66 allows the ball 62 to be tightened into the socket 64 so that the book holder 10 can be held in position for use in a variety of different positions and also for maximal movement and rotation. Preferably, socket mount 68 attaches the joint 60 to the support plate 20 and rear socket mount 67 attaches the joint 60 to the stand 70.

Figure 8:
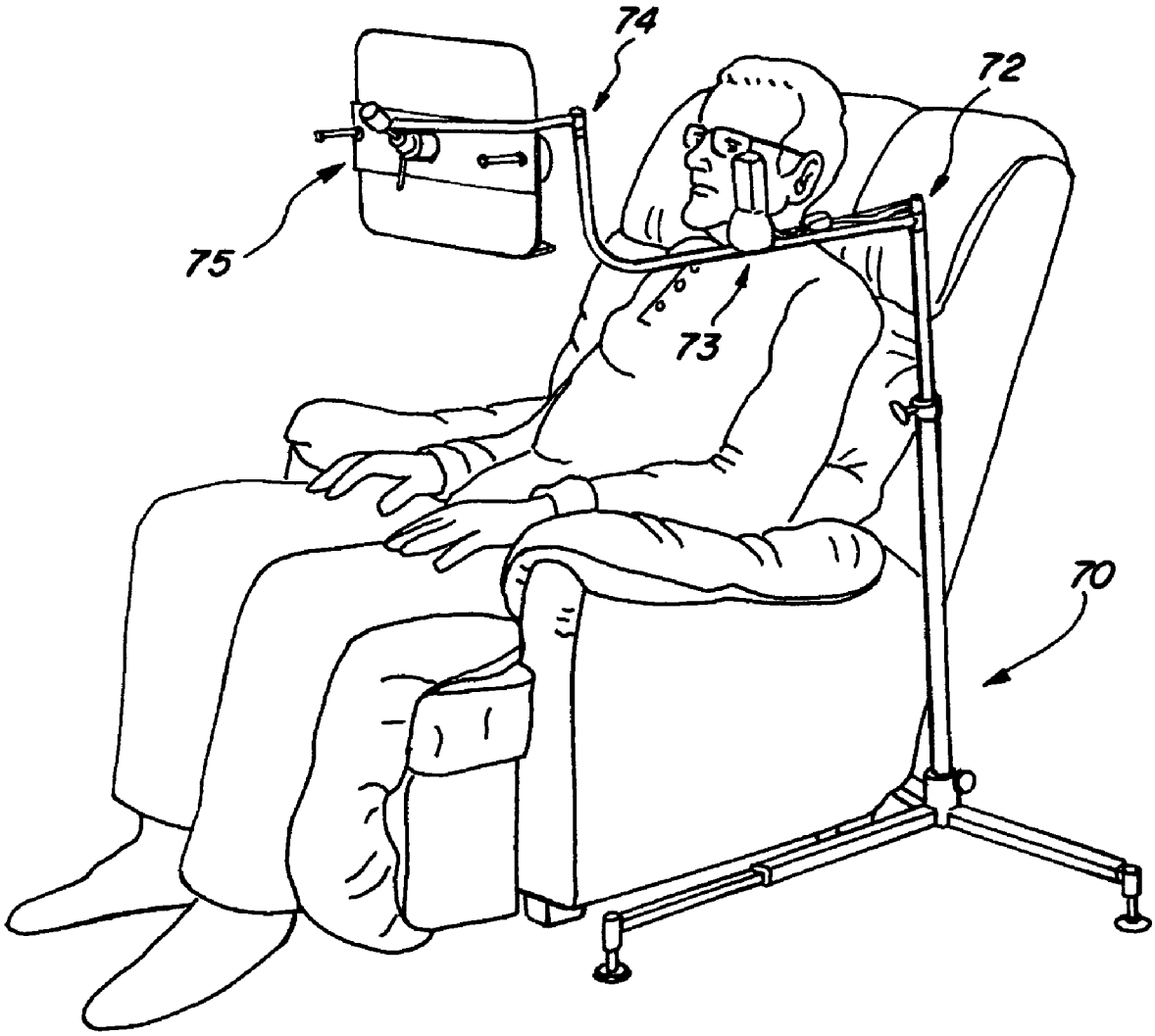
FIG. 8 is a perspective view of a preferred embodiment of the invention with a base in use with a sitting user.
Figure 11:
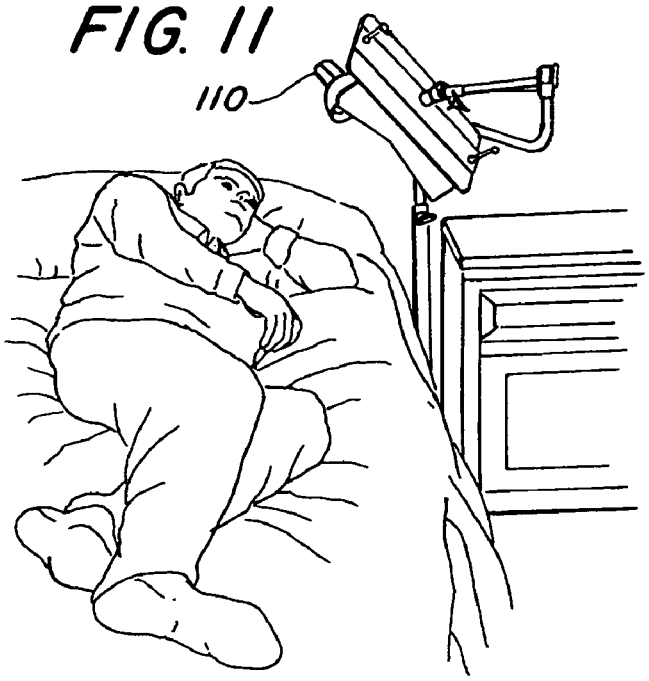
FIG. 11 is a perspective view of a preferred embodiment of the invention in use with a user laying on his side.
Figure 12:
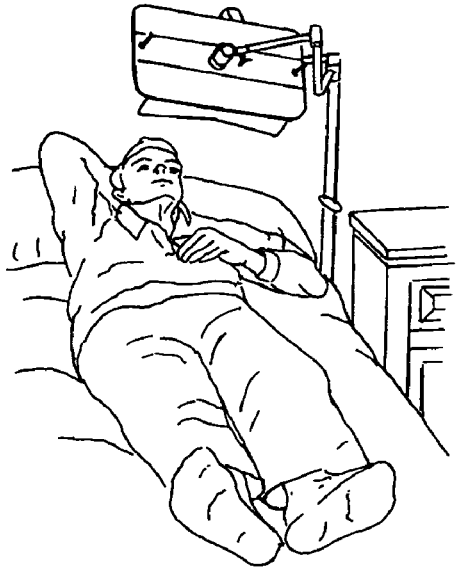
FIG. 12 is a perspective view of a preferred embodiment of the invention in use with a user laying on his back.
Figure 13:
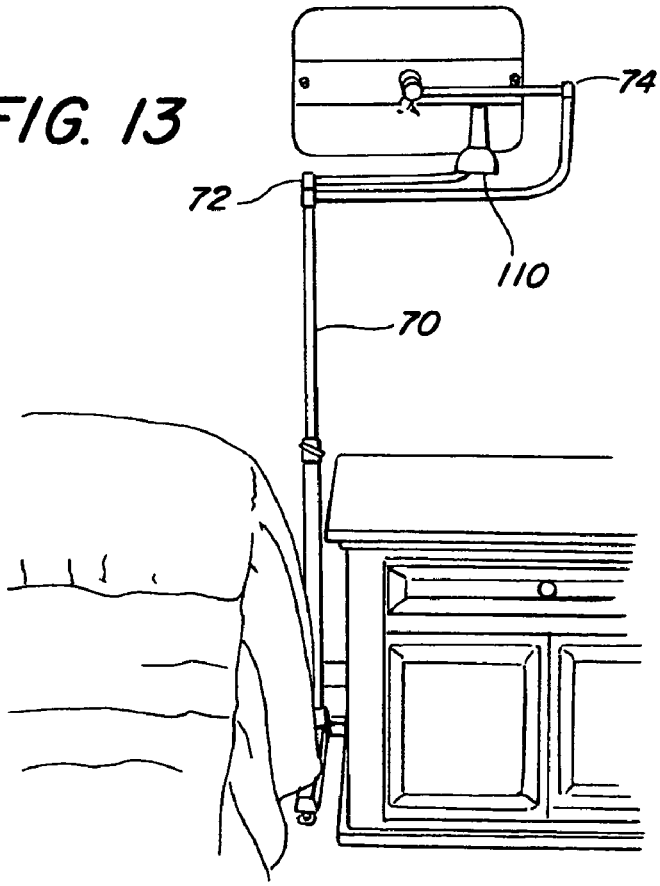
FIG. 13 is a perspective view of a preferred embodiment of the invention in a stored position; and, FIG. 14 is a preferred embodiment of the invention mounted in an adjustable stand with a book and a light.
Figure 14:
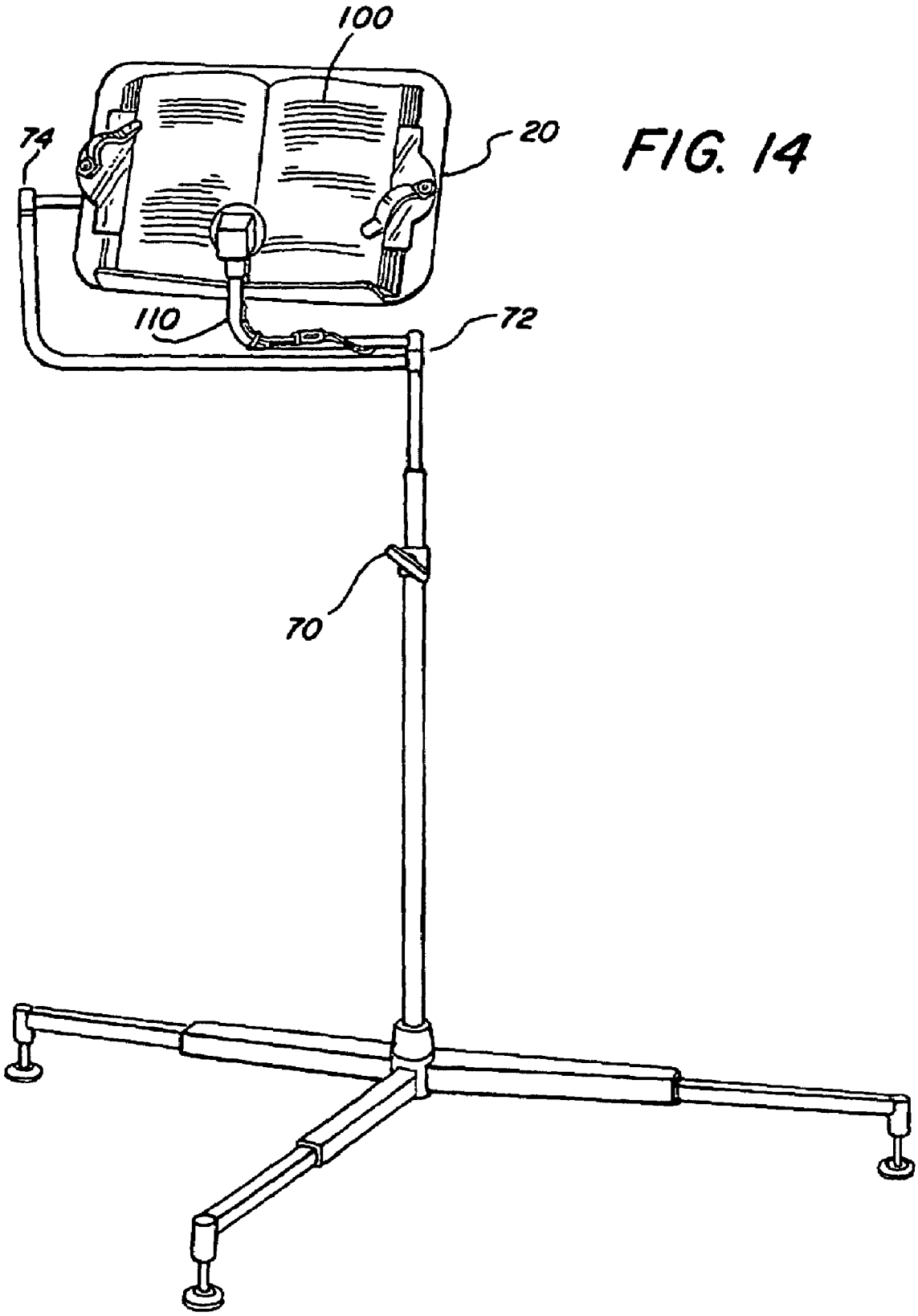

[10] Turning now to FIG. 14 a preferred embodiment of the complete base 70 with a light 110 is shown. In FIG. 8, a preferred embodiment of the complete base 70 is shown while a user reads in the sitting position. The base 70 has arms 73 and 75 pivotally connected at points 72 and 74. Each point 72 and 74 allows 360 degrees of rotation so the book holder can be easily positioned for use and folded away when not in use or for storage. The base 70 is also adjustable in height, preferably by using extendable tubing and extendable legs. The base 70, instead of the stand configuration shown in FIG. 8, can alternately be fixed to a wall at point 72 for use at a fixed position such as a bed. FIGS. 11-13 show the invention 10 in various configurations and positions and as used for various reader positions. A light 110 can be attached to the base 70 at different points for illuminating the reading material 100.

[11] Thus, an improved book holder is described above that is capable of easy adjustment and easy page turning. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A book holder comprising:

a book support plate;

at least one adjustable book clamp comprises a surface of increased friction underneath a page holding and turning finger that is adjustably mounted on the plate and having the page holding and turning finger pivotally connected to the at least one book clamp;

where the page holding and turning finger has a flexible pad on an end of the finger where the surface of increase friction is an arc.

2. The book holder of claim 1 where the flexible pad is made of a type of rubber.

3. The book holder of claim 1 where the page holding and turning finger is curved.

4. A book holder comprising:

a book support plate with a central gear with a plurality of teeth;

a first book clamp adjustably attached to a first toothed arm engaged to the plurality of teeth of the central gear;

and, a second book clamp adjustably attached to a second toothed arm engaged to the plurality of teeth of the central gear wherein, the first and the second book clamps can slide from off the sides of the book support plate to over the top of the book support plates;

where the first book clamp is attached to a first pin; first pin extends through the first toothed arm at a bushing inserted into the first toothed arm.

5. The book holder of claim 4 where the book support plate has a first slot and a second slot whereby the first book clamp is adjustable along the first slot and the second book clamp is adjustable along the second slot.

6. The book holder of claim 4 where the first toothed arm, second toothed arm and the central gear operate to center the first book clamp and the second book clamp around a central point on the book support plate.

7. A book holder comprising:

a book support plate with a central gear with a plurality of teeth;

a first book clamp having a first page holding and turning finger pivotally connected to the first book clamp; the first book clamp adjustably attached by a first pin to a first toothed arm engaged to the plurality of teeth of the central gear; where the first pin extends through the first toothed arm at a first bushing inserted into the first toothed arm; a second book clamp having a second page holding and turning finger pivotally connected to the second book clamp;

the second book clamp adjustably attached by a second pin to a second toothed arm engaged to the plurality of teeth of the central gear; where the second pin extends through the second toothed arm at a second bushing inserted into the second toothed arm; where the first and second page holding and turning fingers each have a flexible pad.

8. The book holder of claim 7 where the first book clamp further comprises a first arc surface of increased friction underneath the first page holding and turning finger; and the second book clamp further comprises a second arc surface of increased friction underneath the second page holding and turning finger.

9. The book holder of claim 7 where the first toothed arm, second toothed arm and the central gear operate to center the first book clamp and the second book clamp around a central point on the book support plate.

10. The book holder of claim 7 where the book support plate is pivotally attached to a stand.

11. The book holder of claim 10 where the book support plate is pivotally attached to the stand at a ball socket joint.

12. The book holder of claim 11 where the ball socket joint is pivotally attached to a horizontal arm pivotally attached to an L-shaped arm pivotally attached to the stand.

* * * * *